US007909642B1

(12) United States Patent
Czarnecki et al.

(10) Patent No.: US 7,909,642 B1
(45) Date of Patent: Mar. 22, 2011

(54) OUTLET CENTER FOR CONNECTING MULTIPLE LOADS TO AN AUXILIARY POWER SOURCE

(75) Inventors: Neil A. Czarnecki, Mt. Pleasant, WI (US); Joseph M. Kampschroer, Whitefish Bay, WI (US)

(73) Assignee: Reliance Controls Corporation, Racine, WI (US)

( * ) Notice: Subject to any disclaimer, the term of this patent is extended or adjusted under 35 U.S.C. 154(b) by 236 days.

(21) Appl. No.: 12/201,698

(22) Filed: Aug. 29, 2008

Related U.S. Application Data

(60) Provisional application No. 60/970,021, filed on Sep. 5, 2007.

(51) Int. Cl.
*H01R 13/66* (2006.01)

(52) U.S. Cl. ..... 439/535; 439/528; 439/571

(58) Field of Classification Search ..... 439/528, 439/535, 536, 539, 571, 650–654
See application file for complete search history.

(56) References Cited

U.S. PATENT DOCUMENTS

| | | | | |
|---|---|---|---|---|
| 3,786,312 | A * | 1/1974 | Roussard | 361/643 |
| 3,895,179 | A * | 7/1975 | Wyatt | 174/50 |
| 5,007,857 | A * | 4/1991 | Wright | 439/490 |
| 5,984,719 | A | 11/1999 | Flegel | |
| D429,688 | S * | 8/2000 | Russo | D13/123 |
| 6,169,340 | B1 | 1/2001 | Jones | |
| 6,227,890 | B1 | 5/2001 | Roper, Jr. et al. | |
| 6,365,990 | B2 * | 4/2002 | Flegel | 307/64 |
| 6,369,321 | B1 * | 4/2002 | Flegel | 174/50 |
| 6,624,533 | B1 | 9/2003 | Swanson et al. | |
| 6,644,987 | B2 * | 11/2003 | Meleck | 439/107 |
| 6,674,031 | B1 * | 1/2004 | Flegel | 200/297 |
| 6,774,307 | B2 * | 8/2004 | Kruse et al. | 174/53 |
| 6,955,559 | B2 | 10/2005 | Pyrros | |
| 7,004,595 | B1 * | 2/2006 | Stoddard | 362/95 |
| 7,015,404 | B2 | 3/2006 | Sodemann et al. | |
| 7,121,707 | B2 * | 10/2006 | Currie et al. | 362/555 |
| 2003/0190838 | A1 * | 10/2003 | Magyar et al. | 439/535 |

FOREIGN PATENT DOCUMENTS

| | | |
|---|---|---|
| EP | 1544981 | 6/2005 |

* cited by examiner

*Primary Examiner* — James Harvey
(74) *Attorney, Agent, or Firm* — Boyle Fredrickson, S.C.

(57) ABSTRACT

The present invention is directed to an outlet center for use with a power inlet box to electrically connect one or more loads to an auxiliary power supply connected to the power inlet box. The outlet center is designed to be mounted to an interior surface of a wall with the power inlet box mounted to an exterior surface of the wall. Electrical conductors extend through the wall between the outlet center and the power inlet box. The outlet center includes sockets adapted to receive the plug of an electrical load so that auxiliary power may be fed to the electrical load during primary power unavailability. The outlet center may illuminate when auxiliary power is available to assist a user in locating the outlet center during blackout conditions and may also include an indicator lamp that illuminates when auxiliary power is being provided to an electrical load connected to the outlet center.

19 Claims, 5 Drawing Sheets

OUTLET CENTER FOR CONNECTING MULTIPLE LOADS TO AN AUXILIARY POWER SOURCE

CROSS-REFERENCE TO RELATED APPLICATION

The present application claims the benefit of U.S. Ser. No. 60/970,021 filed Sep. 5, 2007, the disclosure of which is incorporated herein by reference.

BACKGROUND AND SUMMARY OF THE INVENTION

Auxiliary power sources, such as electric generators, are commonly used to provide power to selected loads during main or utility power supply interruption or failure. In one common approach, a building, such as a home, office, industrial site, etc., will include a subpanel to which certain loads, which may be critical loads of the building, are connected. Non-critical loads will be connected to a main panel. The subpanel, also referred to as a transfer panel, will be interconnected to the auxiliary power supply and the main power supply by a transfer switch. The transfer switch, which may be manually or automatically operated, is designed to selectively connect the subpanel to either the main power supply or the auxiliary power supply. During normal main power supply operation, main power is supplied to the subpanel and the main panel through the transfer switch and ultimately delivered to the critical and non-critical loads. During interruption of the main power supply, the transfer switch, either manually or automatically, disconnects the subpanel from the main power supply and connects the subpanel to the auxiliary power supply. The power delivered by the auxiliary power supply is then provided to the critical loads connected to the subpanel.

In another common approach, the hardwired main panel-subpanel configuration described above is avoided by a direct connection of a load to the auxiliary power supply. In this situation, it is common for an extension cord to be routed through a window or a garage door and interconnected between the load and the auxiliary power supply. Most auxiliary power supplies are engine driven electric generators and therefore must be located outside the building so that exhaust can be properly vented.

The auxiliary power supply will typically include a pair of outlets to which a load may be connected. To connect more than two loads to the auxiliary power supply, a power strip having a series of sockets must be connected to one of the outlets of the auxiliary power supply. The power cords for the various loads may then be connected to the power strip. While the use of power strips is an effective means to increase the number of loads that can be connected to the auxiliary power supply, a user still must route an extension cord through an open window or door to connect the power strip to the auxiliary power supply. This can be particularly problematic during inclement or extremely hot/cold weather. For example, when the generator is located outdoors, the connections of the extension cords to the power strip are exposed to the elements, which is particularly undesirable in rainy conditions, which is not infrequently the case during utility power interruptions.

Accordingly, the present invention provides an alternative approach for connecting a load to an auxiliary power supply, such as an electric generator. In one embodiment, the invention is in the form of a kit that includes a power inlet box having a socket adapted to receive the power plug of the auxiliary power supply, a power outlet center having a plurality of sockets, each of which is adapted to receive the plug of an electrical load, and electrical connectors adapted to electrically connect the power inlet box and the power outlet center. In one implementation, the power inlet box is mounted to the exterior surface of a wall and the power outlet center is mounted opposite the power inlet box to the interior surface of the wall. In this implementation, the electrical connectors pass through an opening in the wall, which may be formed in a conventional manner, and include a protective conduit or sheath. The invention therefore allows a user to make indoor connections of one or more electrical loads to the auxiliary power supply without the need for extension cords running from the electrical load directly to the auxiliary power supply.

In a further embodiment, the power outlet center includes an illumination device that is powered by the auxiliary power supply to assist a user in locating the several sockets of the outlet center during blackout conditions.

In yet another embodiment, the power outlet center may include status lights or LEDs that signal when the power outlet center is being energized by the auxiliary power supply.

Various other features and advantages of the present invention will be made apparent from the following detailed description and the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENTS

Figure 1:
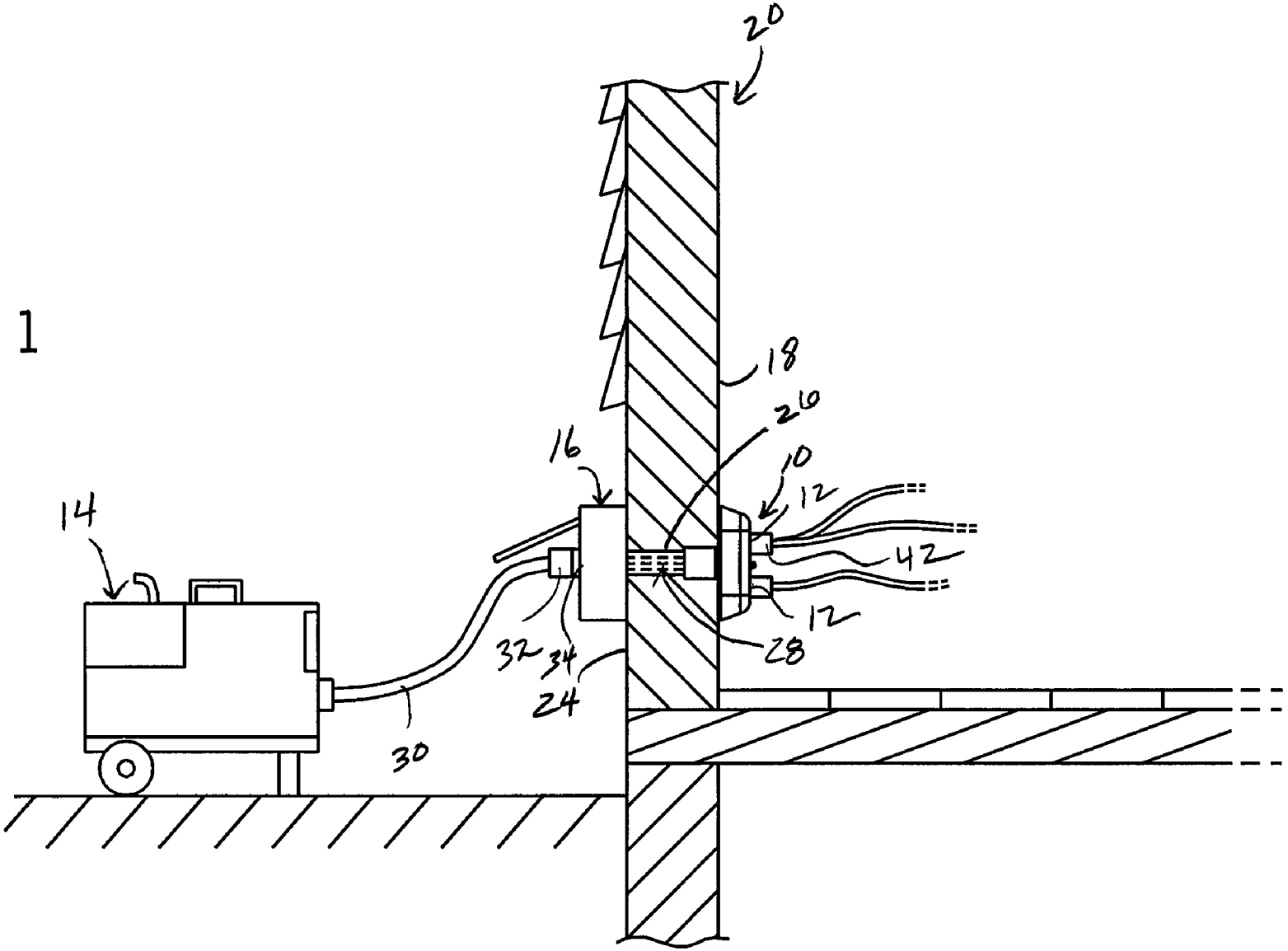
FIG. 1 is a schematic representation of an assembly for interconnecting multiple loads to a remote auxiliary power supply, such as an electric generator, that includes a power outlet center to which one or more electrical loads may be connected and a power inlet box to which the auxiliary power supply may be connected, to provide power to the electrical loads connected to the power outlet center according to one embodiment of the present invention.

Referring to FIG. 1, the present invention includes a wall mounted power outlet center 10 that includes a plurality of outlets 12 or sockets that are interconnected to an auxiliary power supply 14, such as an engine-driven generator, by a wall mounted power inlet box 16. The power outlet center 10 is adapted to be mounted to an interior surface 18 of an exterior wall 20 of a building 22 whereas the power inlet box 16 is adapted to be mounted to an opposite, exterior surface 24 of the exterior wall 20. A sheathed cable or conduit 26 containing electrical connectors 28 extends between the power outlet center 10 and the power inlet box 16 so that power delivered to the power inlet box 16 is available at the sockets 12 of the power outlet center 10. In a preferred embodiment, the sheathed cable or conduit 26 extends through a bore or opening 30 extending linearly through the wall 20 between the mounted power outlet center 10 and the power inlet box 16. In one embodiment, the sheath of the cable or conduit 26 is formed of PVC, but other materials may be used.

As known in the art, the electric generator 14 includes a power cable 30 that terminates in a plug 32 that is adapted to be received in a socket 34 of the power inlet box 16, as known in the art. Although the invention is not limited to any particular type of power inlet box, one exemplary power inlet box is described in U.S. Ser. No. 12/199,490, the disclosure of which is incorporated herein by reference.

Figure 2:
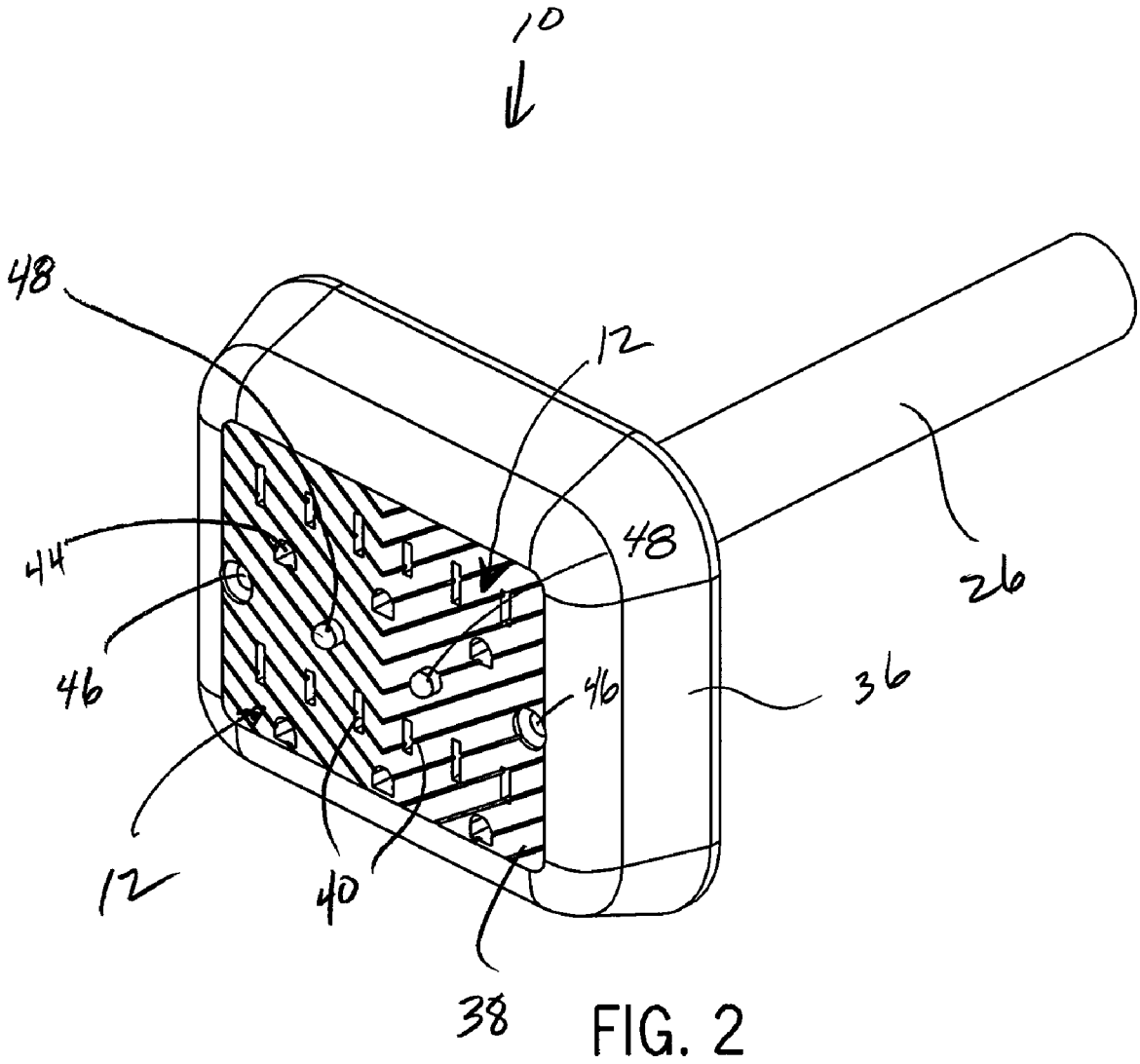
FIG. 2 is an isometric view of the power outlet center of FIG. 1 according to one embodiment of the invention.

The power outlet center 12 according to one embodiment of the invention is shown in FIG. 2. The power outlet center 12 includes a housing 36 having a face 38 in which sockets 12 are formed. As known in the art, each socket 12 includes slots 40 configured to receive blades (not shown) of the plug 42, FIG. 1, of an electrical load (not shown) or an extension cord (not shown). In the illustrated embodiment, each socket 12 also includes a hole 44 that is configured to receive the ground contact of the plug 42.

The sheath of cable or conduit 26 extends from the backside (not numbered) of the housing 36 and provides a protective housing for electrical connectors 28. As will be described further below, in one preferred embodiment, the sheath of cable or conduit 26 is formed of material that can be cut as desired by a user. In a conventional manner, the electrical connectors 28 are connected to the sockets to allow current to flow from the auxiliary power supply 14 to the electrical loads connected to the power outlet center 10. While six sockets 12 are shown, it is contemplated that the power outlet center 10 may have more or less than six sockets 12. Additionally, it is also contemplated that for some applications it may be desirable to have a single power outlet center having sets of sockets, with the sets electrically isolated from one another and powered by separate auxiliary power supplies. This later embodiment may be particularly advantageous in industrial or office applications in which multiple generators may be needed to power a number of loads.

It will be appreciated that the invention allows for a fixed connection point to be established in the building for connecting various cord-connected loads to the auxiliary power supply 14 without being connected to the main breaker box or panel of the building. Moreover, since the power outlet center 10 has multiple sockets 12, e.g., six three-prong outlets, the need for a power strip or similar device is reduced. Additionally, the need to route an extension cord from the auxiliary power supply through a door or window to a load is avoided.

The power outlet center 10 may include a pair of openings 46, which are configured to receive screws or other connectors for use in securing the outlet center 10 to interior surface 18 of the exterior wall 20 of building 22. In addition, the power outlet center 10 may include a light source 48, which may be in the form of a pair of LEDs 48 that are powered by the auxiliary power supply 14. The LEDs 48 function to illuminate the sockets 12 to assist with inserting plugs into the outlets, and also indicate an operating status of the auxiliary power supply 14. Thus, in one embodiment, the power outlet center 10 includes circuitry that detects the operating status of the auxiliary power supply 14 and illuminates an LED 48 accordingly.

The power inlet box 16 is designed to be mounted to the exterior surface 24 of wall 20 in a conventional manner. The power inlet box 16 has a housing 50 suitable for exterior mounting and a socket 52 configured to receive a mating plug 32 of a power cord 30 connected to the auxiliary power supply 14. Preferably, the power inlet box 16 has a cover plate 54 that protects the socket 50 when in a closed position. The outlet center 10 may be mounted in a suitable location in the building, such as in the wall of a basement, a garage, or a first floor of the building.

Figure 3:
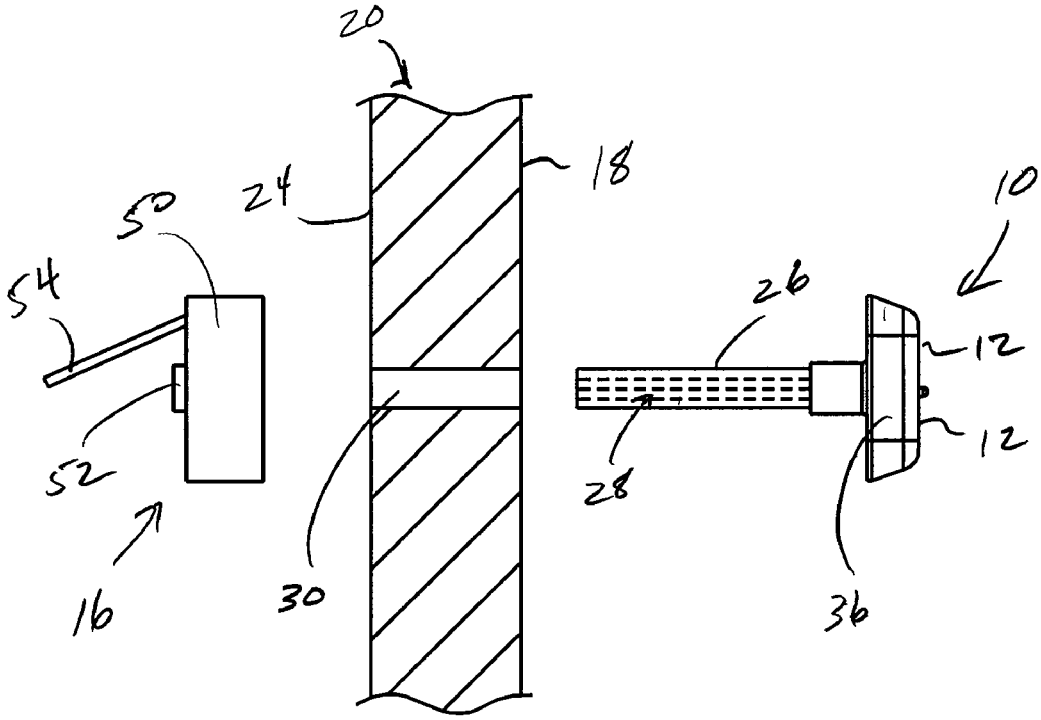
FIGS. 3-6 illustrate stages of mounting the power outlet center and the power inlet box of the kit shown in FIG. 1 according to one embodiment of the invention.

In a typical installation, the homeowner or installer first bores a hole through the exterior wall 20, as shown in FIG. 3, using a drill or other conventional boring device. The opening is formed of sufficient diameter to receive the sheath of the cable or conduit 26 of the power outlet center 10.

Figure 4:
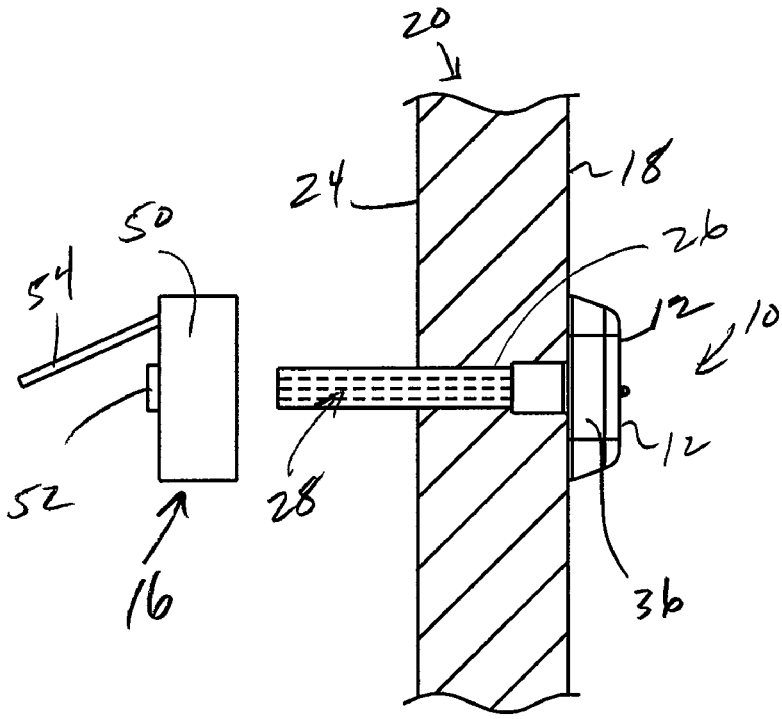
Figure 5:
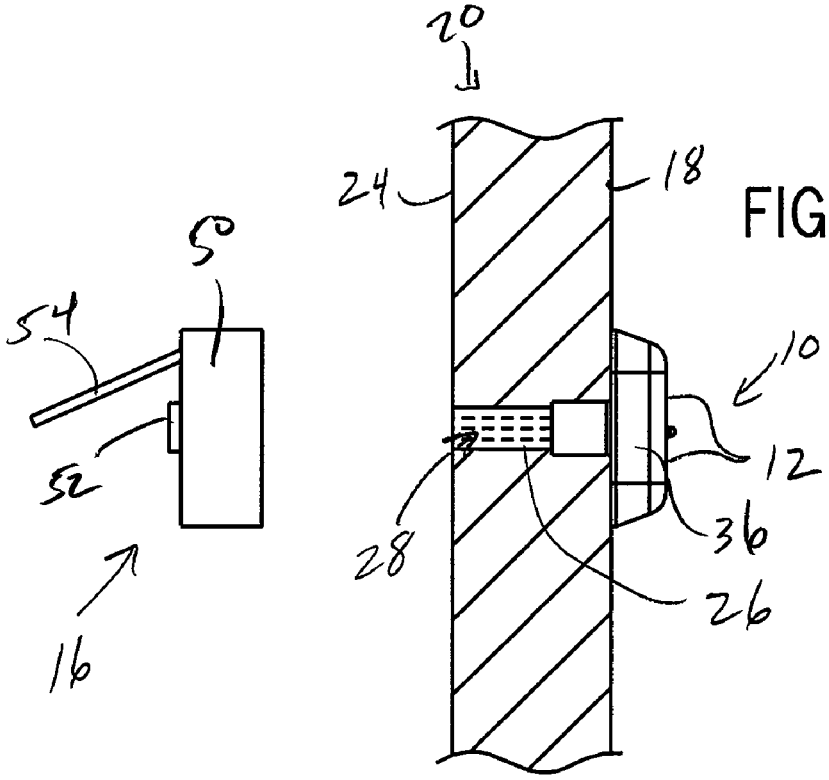
Figure 6:
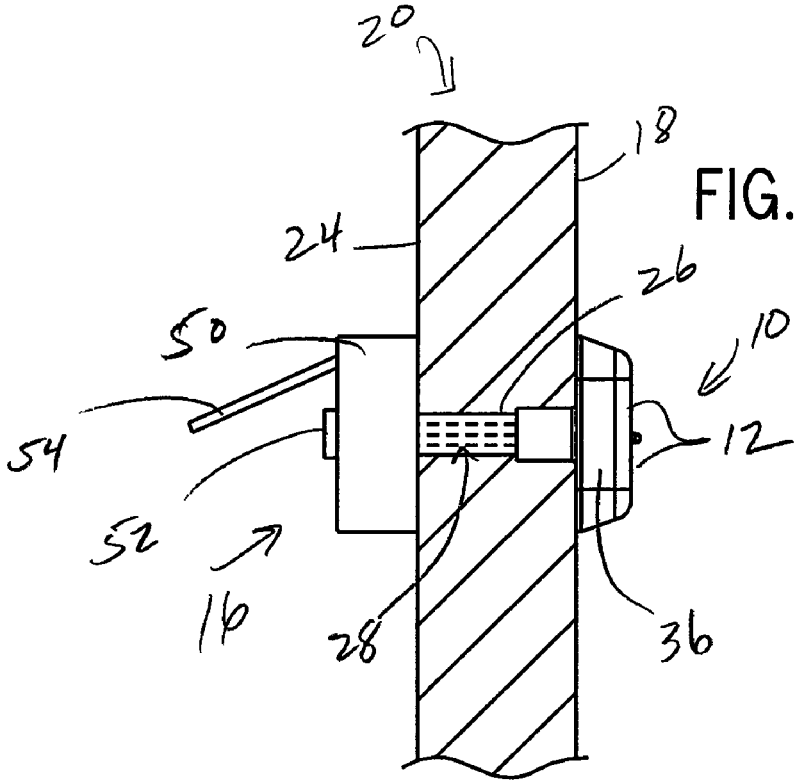

Once a suitable opening is formed, the power outlet center 10 is mounted to the interior surface 18 of the exterior wall 20, as shown in FIG. 4. The outlet center 10 may be mounted in a conventional manner using suitable bolts, screws, etc. through openings 46 and into the wall 20. The outlet center 10 should be mounted after the sheath of the cable or conduit 26 has been extended through the opening to the opposite side of the wall 20, i.e., accessible at the exterior surface 24 of the wall 20. In one embodiment, the sheath of the cable or conduit 26 and the electrical conductors 28 may be formed of material that allows the sheath and the conductors 28 to be cut to a desired length, as shown in FIG. 5. Once the sheath of the cable or conduit 26 is cut to a desired length, the power inlet box 16 is connected to the sheath of the cable or conduit 26, and the socket 52 of the power inlet box 16 is connected to the electrical conductors 28 in a conventional manner and the power inlet box 16 is then mounted to the exterior surface of the 24 of the wall 20, as shown in FIG. 6. It is contemplated that the power outlet center 10 may be mounted to the wall 20 at a below grade location, e.g., in a basement, as well as an above-grade location, e.g., in a first floor.

In use, the user simply places generator 14 is a suitable location, such as outdoors or in a garage, and then connects cord 54 to the power inlet box 16 to provide power to the outlet center 10. The user then connects any desired number of power cords, typically extension cords, to the outlet center 10 for providing power to desired loads in the event of a utility power outage.

In addition, while electrical conductors 28 and the cable or conduit 26 are shown and described as extending from the power outlet center 10, it is contemplated that the electrical conductors 28 and sheath 26 may extend from a backside of the power inlet box 16.

Figure 7:
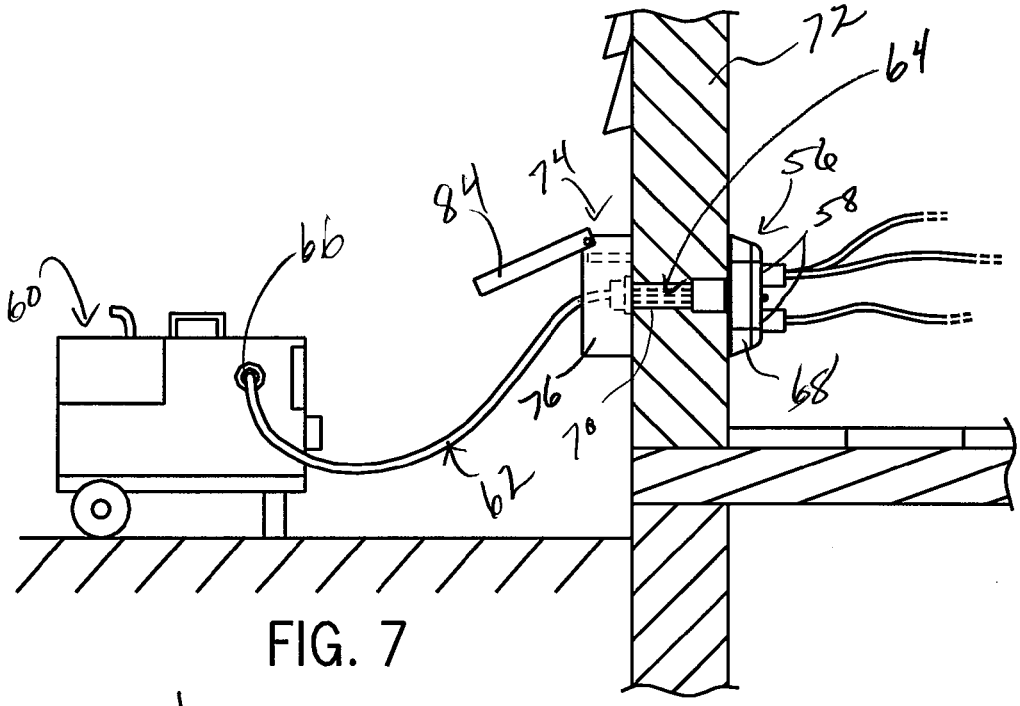
FIG. 7 is a schematic representation of an assembly for interconnecting multiple loads to a remote auxiliary power supply, such as an electric generator, that includes a power outlet center to which one or more electrical loads may be connected and a power inlet box to which the auxiliary power supply may be connected, to provide power to the electrical loads connected to the power outlet center according to another embodiment of the present invention.
Figure 8:
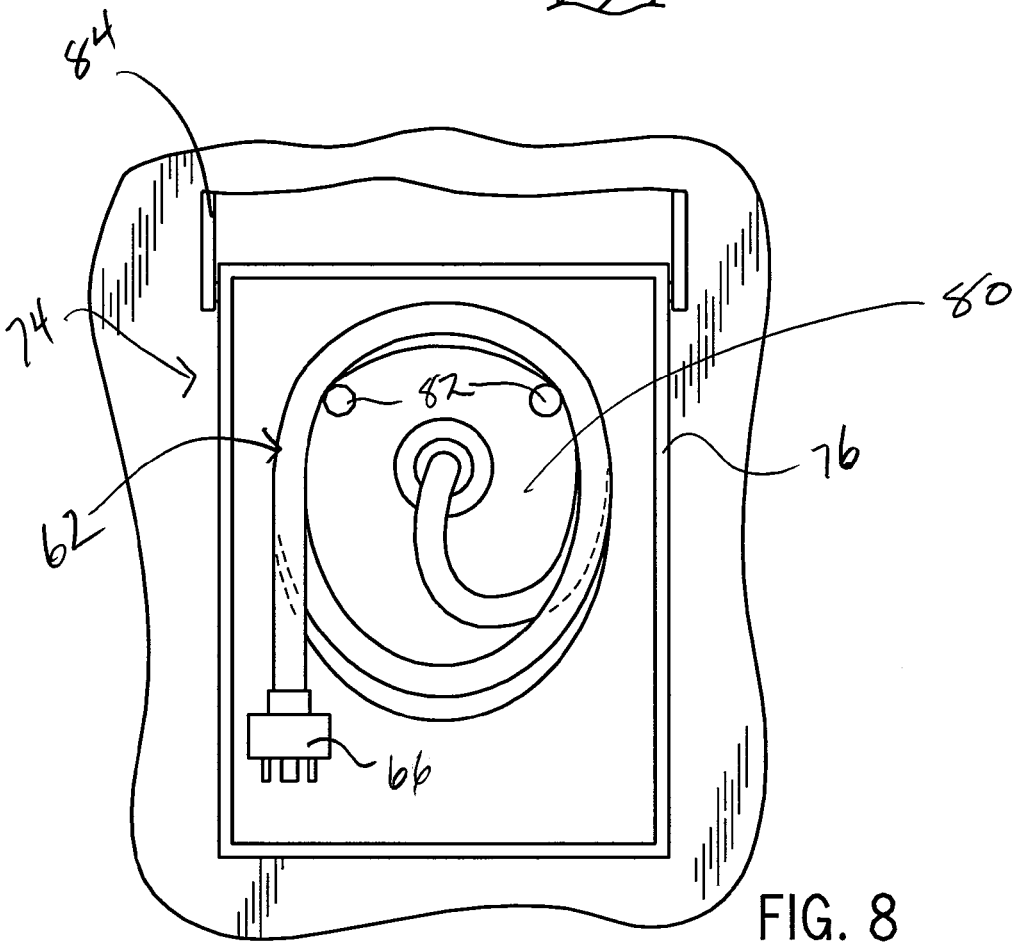
FIG. 8 is an end view of the power inlet box shown in FIG. 7.

FIGS. 7 and 8 illustrate a power outlet center 56 according to another embodiment of the present invention. The power outlet center 56 includes a plurality of outlets 58 or sockets that may be energized by an auxiliary power supply 60, such an engine driven generator, through a power cable 62 containing a series of power leads 64 hardwired to the outlets 58 at one end and terminating in a plug 66 at an opposite end. In this regard, the power outlet center 56 includes a housing 68 with an integrated power cable 62 for direct connection to the auxiliary power supply 60. Alternately, the power cable 62 and the power outlet center 56 may be separate components that are assembled when the power outlet center 56 is installed.

In one embodiment, a conduit 70 extends from the backside of the housing 68 and is designed to fit in an opening formed in wall 72. In this embodiment, a portion of the power cable 62 is contained within the conduit 70.

In one representative embodiment, the power cable 62 is integrally formed with the power outlet center 56. To install the power outlet center 56, an opening is formed in wall 72 of sufficient size to pass the power cable 62 and its plug 66. The plug-end of the power cable 62 is the fed through the opening and the housing 68 is mounted to the wall 72 in a conventional manner. The plug 66 may then be engaged with a socket of the auxiliary power supply 60. Thus, when the auxiliary power supply 60 is operating, loads connected to the power outlet center 56 via sockets 58 may then be powered.

In a preferred embodiment, the power cable 62 may be stored in storage box 74 mounted to the wall 72 opposite the power outlet center 56, as shown in FIG. 8. The storage box 74 has a housing 76 suitable for exterior mounting and includes a back plate 80 having a pair of hangers 82 extending therefrom. When storing the power cable 62, the power cable 62 can be wrapped around the hangers 82 to secure the power cable 62 in the housing 76. Preferably, the storage box 74 includes a cover plate 84 that protects the cable 62 when the cover plate 84 is in the closed position. It is understood that other types of retention devices may be used to hold the cable in box 74. Further, it is contemplated that power outlet center 56 may include various lights and indicators as described with respect to power outlet center 10.

In one embodiment, the present invention is available as a kit that can be quickly assembled, such as by a homeowner or handyman, to provide the fixed connection of the load center to the auxiliary power supply as described above.

It is noted that an outlet center having fewer or more than six outlets may be used. Additionally, in one embodiment, the outlet center is rated for 110, 15 A operation; although, it is contemplated that the outlet center may also be differently rated, such as 220V, 30 A.

It is contemplated that the housing may be contained within a suitable junction box or integrally formed with a junction box.

The present invention has been described in terms of the preferred embodiment, and it is recognized that equivalents, alternatives, and modifications, aside from those expressly stated, are possible and within the scope of the appending claims.

We claim:

1. A power supply arrangement for connecting one or more loads to an auxiliary power supply, the power supply arrangement comprising:

a power outlet center having a plurality of sockets adapted to receive a plug connected to an electrical load;

a power inlet member having a socket adapted to receive a plug connected to the auxiliary power supply;

electrical conductors extending from one of the power outlet center and the power inlet member and connectable to the other one of the power outlet center and the power inlet member to electrically connect the power outlet center to the power inlet member;

wherein the power outlet center is mounted adjacent a first surface of a wall and the power inlet member is mounted adjacent a second surface of the wall, and wherein the plurality of conductors extend through a passage in the wall between the power inlet member and the power outlet center.

2. A power outlet center for electrically connecting an electrical load to an auxiliary power supply, comprising:

a housing defining a rear portion;

a plurality of electrical sockets associated with the housing;

a power cable extending from the rear portion of the housing and containing electrical conductors connected to the electrical sockets and a plug connected to the electrical conductors, the plug adapted to engage a socket of the auxiliary power supply; and wherein the housing is mounted adjacent a first surface of a wall and wherein the electrical conductors extend through a passage in the wall between the housing and the plug, wherein the plug is located outwardly of a second surface of the wall opposite the first surface.

3. The power supply arrangement of claim 1 wherein the housing is formed of plastic.

4. The power supply arrangement of claim 1 further comprising a light source mounted to the housing and wherein the light source is adapted to illuminate the plurality of sockets.

5. The power supply arrangement of claim 1 further comprising a non-conductive sheath extending between the power outlet center and the power inlet member and sized such that the plurality of electrical conductors extend therethrough, wherein the non-conductive sheath extends though the passage in the wall.

6. The power supply arrangement of claim 5 wherein the non-conductive sheath is formed of PVC.

7. The power supply arrangement of claim 1 wherein the power inlet member comprises a power inlet box and includes an access panel carrying the socket adapted to receive the plug connected to the auxiliary power supply and wherein the access panel includes a door that when opened exposes the socket and when closed covers the socket.

8. The power supply arrangement of claim 7 wherein the access panel is adapted to be surface mounted.

9. The power supply arrangement of claim 1 wherein the auxiliary power supply is an electric generator.

10. The power supply arrangement of claim 9 wherein the electric generator is an engine driven generator.

11. The power outlet center of claim 2 wherein the power cable is integrally formed with the housing.

12. The power supply arrangement of claim 1 further comprising a light proximate the power outlet center that is illuminated by power provided thereto by the auxiliary power supply.

13. The power supply arrangement of claim 12 wherein the light illuminates the plurality of sockets.

14. The power supply arrangement of claim 1 wherein the plurality of sockets includes six three-prong sockets.

15. A method of mounting an auxiliary power supply arrangement to a wall of a building for connecting a plurality of loads to an electric generator, the method comprising:

forming a passage through an exterior wall of a building;

extending electrical conductors through the passage;

mounting an outlet center, connected to the electrical conductors, to a first surface of the exterior wall;

connecting the electrical conductors to a power inlet member; and mounting the power inlet member to a second surface, opposite the first surface, of the exterior wall.

16. The method of claim 15 further comprising cutting the electrical conductors to a desired length before connecting the electrical conductors to the power inlet member.

17. A power outlet center for electrically connecting an electrical load to an auxiliary power supply, comprising:

a housing defining a front portion and a rear portion;

electrical sockets associated with the front portion of the housing;

a sheath extending from the rear portion of the housing;

electrical conductors connected to the electrical sockets and extending from the electrical sockets through the sheath to a power inlet member adapted to be connected to the auxiliary power supply; and wherein the housing is mounted adjacent a first surface of a wall and the power inlet member is mounted adjacent a second surface of the wall and wherein the sheath and the electrical conductors extend through a passage in the wall between the power inlet member and the power outlet center.

18. The power outlet center of claim 17 further comprising an LED configured to illuminate when an electrical load is connected to a socket and current is being delivered to the electrical load by the auxiliary power supply.

19. The power outlet center of claim 17 further comprising an illumination device associated with the front portion and configured to illuminate when power is being supplied thereto by the auxiliary power supply.

* * * * *